US008083455B2

(12) United States Patent
Graushar et al.

(10) Patent No.: US 8,083,455 B2
(45) Date of Patent: Dec. 27, 2011

(54) COVER APPLIER SYSTEM

(75) Inventors: William T. Graushar, Elm Grove, WI (US); David F Christofferson, Sussex, WI (US); Timothy A. Heimerl, West Bend, WI (US); William H. Schnell, Menomonee Falls, WI (US)

(73) Assignee: Quad/Tech, Inc., Sussex, WI (US)

( * ) Notice: Subject to any disclaimer, the term of this patent is extended or adjusted under 35 U.S.C. 154(b) by 898 days.

(21) Appl. No.: 12/032,144

(22) Filed: Feb. 15, 2008

(65) Prior Publication Data

US 2008/0199276 A1 Aug. 21, 2008

Related U.S. Application Data

(60) Provisional application No. 60/890,289, filed on Feb. 16, 2007.

(51) Int. Cl.

| | |
|---|---|
| ***B42C 11/00*** | (2006.01) |
| ***B42C 13/00*** | (2006.01) |
| ***B42C 11/02*** | (2006.01) |
| ***B42C 11/04*** | (2006.01) |
| ***B42B 9/00*** | (2006.01) |

(52) U.S. Cl. ..... 412/5; 412/4; 412/11; 412/13; 412/18; 412/19; 412/20; 412/21

(58) Field of Classification Search ..... 412/4–5, 412/11, 13, 18–21

See application file for complete search history.

(56) References Cited

U.S. PATENT DOCUMENTS

| | | | | |
|---|---|---|---|---|
| 3,556,283 | A | 1/1971 | Brundage | |
| 3,816,866 | A * | 6/1974 | Miaskoff et al. | 412/11 |
| RE29,105 | E * | 1/1977 | Miaskoff et al. | 412/12 |
| 4,080,678 | A * | 3/1978 | Muller | 412/13 |
| 4,505,629 | A | 3/1985 | Lynch | |
| 5,232,324 | A * | 8/1993 | Graushar | 412/4 |
| 5,261,769 | A * | 11/1993 | Leclerc | 412/4 |
| 5,316,281 | A | 5/1994 | Bale et al. | |
| 5,316,425 | A * | 5/1994 | Graushar et al. | 412/19 |
| 5,429,468 | A * | 7/1995 | Kojima | 412/19 |
| 5,538,570 | A | 7/1996 | Tooker | |
| 5,634,633 | A * | 6/1997 | Graushar | 412/13 |
| 5,662,448 | A * | 9/1997 | Graushar et al. | 412/4 |
| 5,777,443 | A * | 7/1998 | Chang | 270/52.17 |
| 5,988,620 | A * | 11/1999 | Graushar | 412/13 |
| 6,024,682 | A * | 2/2000 | Mandel et al. | 270/32 |
| 6,237,908 | B1 | 5/2001 | Chang et al. | |
| 6,302,388 | B1 * | 10/2001 | Graushar et al. | 412/13 |

(Continued)

FOREIGN PATENT DOCUMENTS

| | | |
|---|---|---|
| GB | 2116151 | 9/1983 |

*Primary Examiner* — Dana Ross

*Assistant Examiner* — Kyle Grabowski

(74) *Attorney, Agent, or Firm* — Michael Best & Friedrich LLP

(57) ABSTRACT

A system for positioning a cover relative to a book block. The system comprises a drive unit to cause movement of at least one of the book block and the cover and a position sensor operable to detect at least one of a position of the book block and the cover. The position sensor is operable to generate a position signal indicative of the position. The system also comprises a controller in communication with the position sensor and the drive unit. The controller is operable to receive the position signal and to control the drive unit based on the position signal to adjust a relative position of the cover and the book block.

15 Claims, 18 Drawing Sheets

U.S. PATENT DOCUMENTS 6,352,252 B1 3/2002 Schmucker et al.
6,575,445 B1 * 6/2003 Garlichs et al. ..... 412/19
6,685,416 B2 2/2004 Itoh et al.
6,717,286 B2 4/2004 Tsuchiya et al.
6,966,553 B2 11/2005 Rathert
2003/0215309 A1 * 11/2003 Engert et al. ..... 412/19
2004/0216425 A1 11/2004 Morton et al.
2006/0140743 A1 6/2006 Marsh

* cited by examiner

COVER APPLIER SYSTEM

CROSS-REFERENCE TO RELATED APPLICATIONS

This application claims priority to U.S. Provisional Patent Application No. 60/890,289, filed Feb. 16, 2007, the entire contents of which are hereby incorporated by reference.

BACKGROUND

The present invention relates to a binding system. More specifically, the present invention relates to a cover applier system for use in a binding system.

A cover is typically secured to a book block after the book block has been printed and assembled to form a bound article such as a book or magazine. The cover can either be stitched (e.g., stapled) to the book block by a saddle stitcher or glued to the book block by a perfect binder. In either situation, it is cosmetically important to align the cover with the book block prior to securing the two together.

SUMMARY

In one embodiment, the invention provides a system for positioning a cover relative to a book block. The system comprises a drive unit to cause movement of at least one of the book block and the cover and a position sensor operable to detect at least one of a position of the book block and the cover. The position sensor is operable to generate a position signal indicative of the position. The system also comprises a controller in communication with the position sensor and the drive unit. The controller is operable to receive the position signal and to control the drive unit based on the position signal to adjust a relative position of the cover and the book block In another embodiment, the system comprises a first driven member configured to move the cover, a second driven member configured to move the book block, and a position sensor operable to detect at least one of a position of the book block and the cover. The position sensor is operable to generate a position signal indicative of the position. The system also comprises a controller coupled to the position sensor and at least one of the first and second driven members. The controller is operable to receive the position signal and to control the at least one of the first and second driven members based on the position signal to adjust a relative position of the cover and the book block such that the relative position is adjusted toward a predetermined position.

In yet another embodiment, the invention provides a method of assembling a printed publication. The method comprises detecting at least one of a position of a book block and a cover and adjusting a relative position of the cover and the book block based on the detected position.

In another embodiment, the method comprises detecting a position of the book block and positioning the cover in a predetermined position with respect to the book block based on the detected position.

In still another embodiment, the invention provides a method of positioning a cover relative to a book block. The method comprises detecting at least one of a position of the book block and the cover and controlling a driven member transporting the at least one of the book block and the cover based upon the detected position to position the at least one of the book block and the cover toward a predetermined relative position with respect to each other.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
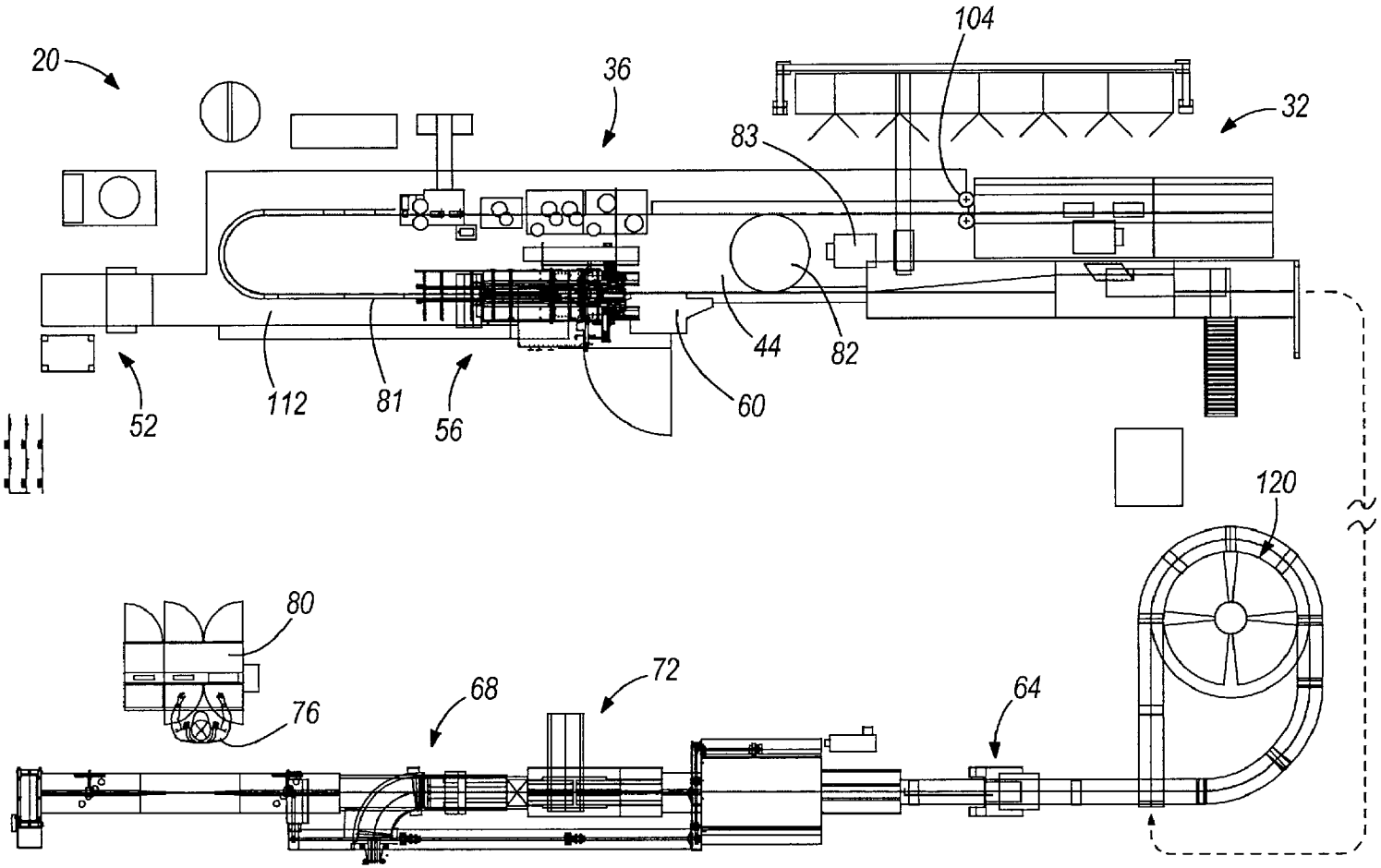
FIG. 1 is a top view of a binding system according to one embodiment of the invention.
Figure 7:
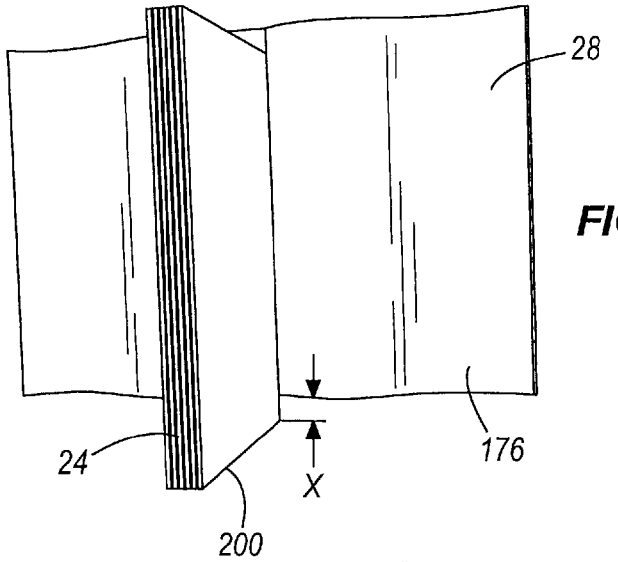
FIG. 7 illustrates the cover offset from the book block longitudinally.

FIG. 1 illustrates a binding system 20 for creating bound articles, or printed publications, such as magazines, books, pamphlets, brochures, or the like. A bound article is typically composed of a book block 24 (e.g., a stack of pages or signatures comprising the substantive portion of the bound article) and a cover 28 surrounding or covering the book block 24 (see FIGS. 7-9). In the illustrated embodiment, the cover 28 is glued to the book block 24 using a perfect bound system. However, it should be readily apparent to one skilled in the art that, in other embodiments, the cover 28 may be stapled to the book block 24 with a saddle stitcher.

In the embodiment illustrated in FIG. 1, the binding system 20 includes a book block gatherer 32 to collect and collate loose signatures of a book block after printing, a book block rougher 36 to roughen and trim a binding edge 40 of the signatures (FIG. 6), and a carousel 44. The carousel 44 includes a plurality of clamps 48 (e.g., forty to sixty clamps) (FIG. 6) that grab signatures from the gatherer 32 and transport the signatures through the rougher 36. The binding system 20 also includes a cover feeder 52 to feed cover wrappers and covers 28 into the system 20, a cover applier system 56 to attach the covers 28 to the book blocks 24, and a cover breaker 60 to fold the covers 28. Additionally, the illustrated binding system 20 includes a trimmer 64 to trim the book blocks 24 and the attached covers 28 (i.e., collectively the bound articles), a polywrapper 68 to enclose the bound articles in a wrapper, and a distributor 72 to separate the bound articles for mailing or distribution. In the illustrated embodiment, the binding system 20 is controlled and monitored by an operator 76 at a control station 80.

Figure 2A:
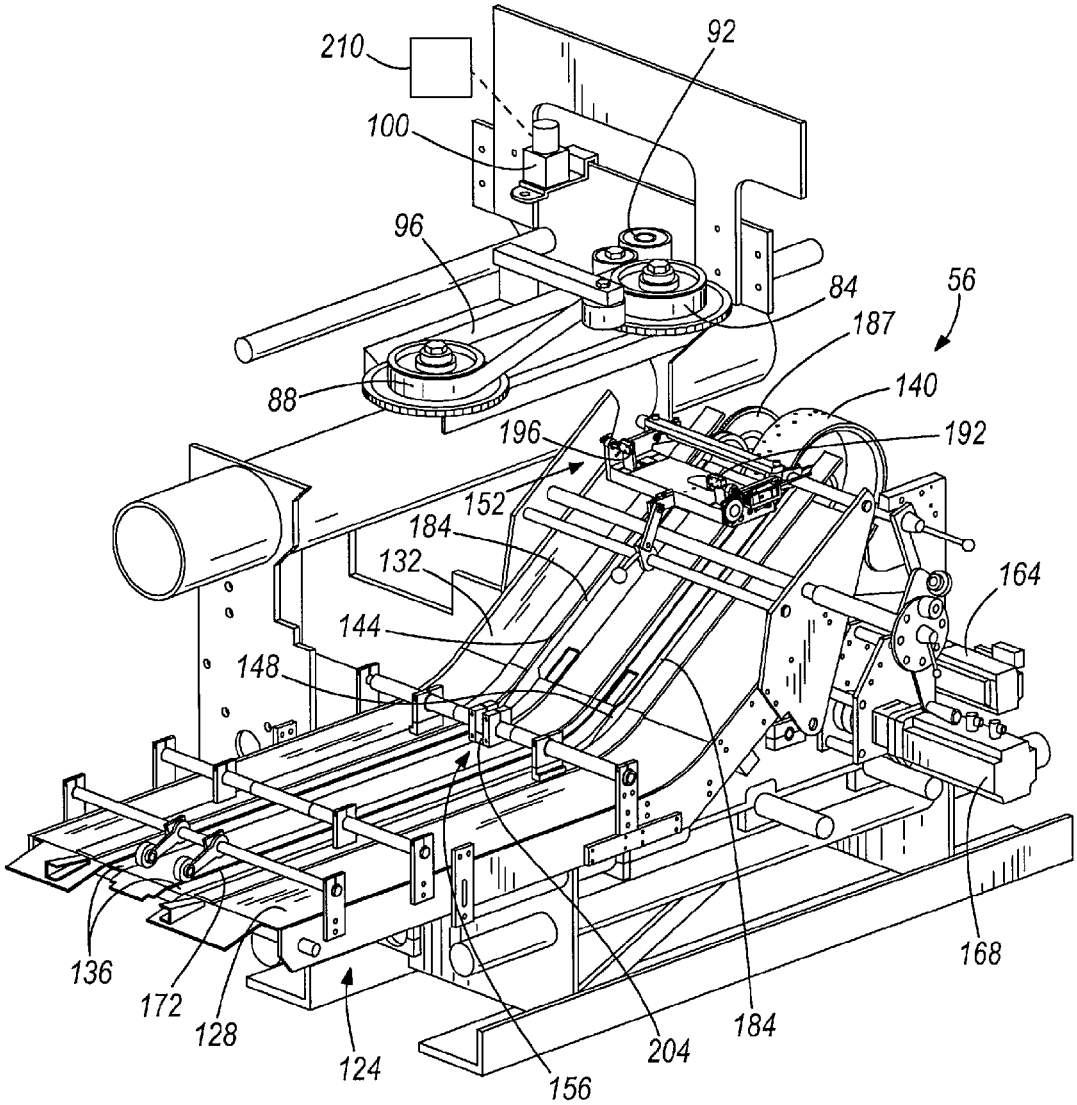
FIG. 2A is a perspective view of a cover applier system for use with the binding system shown in FIG. 1.

The carousel 44 includes a book clamp chain 81, a main drive sprocket 82 coupled to the book clamp chain 81, and a main motor, or drive unit, 83 that drives the main drive sprocket 82 to drive the book clamp chain 81. An internal portion of the carousel 44 is shown in FIG. 2A. Movement of the book clamp chain 81 is perceived by two tangential drive sprockets/pulleys 84, 88 that pick up direct motion of book clamp chain 81. The tangential drive sprockets/pulleys 84, 88 drive an encoder pulley 92 through an endless belt 96. The encoder pulley 92 in turn drives a real master encoder 100 such that each revolution, or cycle, of the book clamp chain 81 is in a predetermined ratio with each revolution, or cycle, of the real master encoder 100. In the illustrated embodiment, the ratio of a book clamp chain cycle to a real master encoder cycle is 1:1. In other embodiments, the ratio may be a different value.

Referring back to FIG. 1, after the signatures of the book blocks are printed, the signatures are deposited in the gatherer 32, stacked, and directed toward the carousel 44. An in-feed roller 104 positioned before the carousel 44 stands the signatures on their binding edges 40 so that when the clamp 48 grabs the signatures, the binding edge 40 remains exposed below a bottom surface 108 of the clamp 48 (see FIG. 6). The clamps 48 carry the signatures through the rougher 36 where the exposed binding edge 40 is trimmed and roughened, preparing the binding edge 40 for attachment to the cover 28. At this time, a layer of glue may be applied to the binding edge 40 such that the signatures form a book block 24.

Figure 2B:
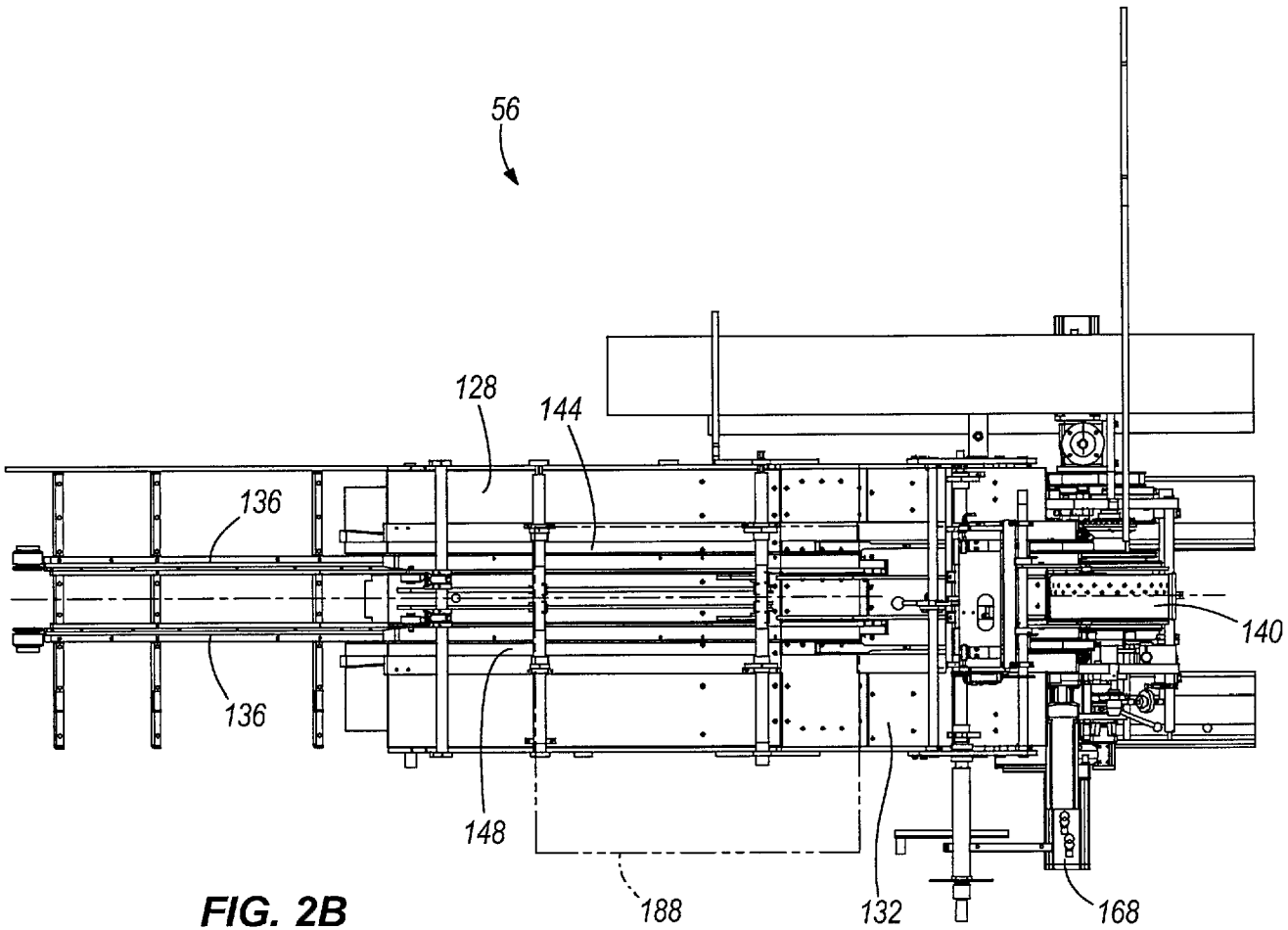
FIG. 2B is a top view of the cover applier system shown in FIG. 2A.
Figure 2C:
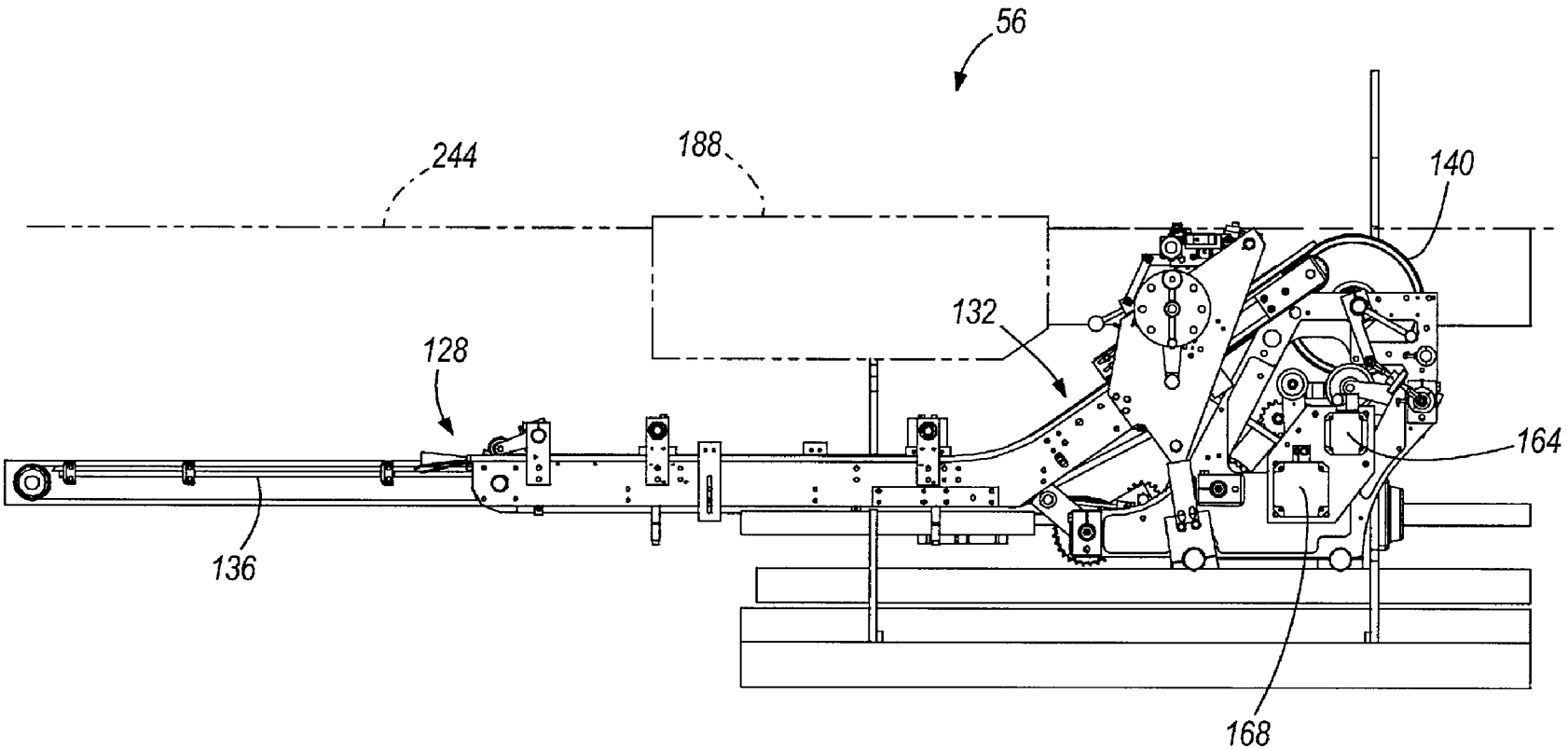
FIG. 2C is a side view of the cover applier system shown in FIG. 2A.
Figure 2D:
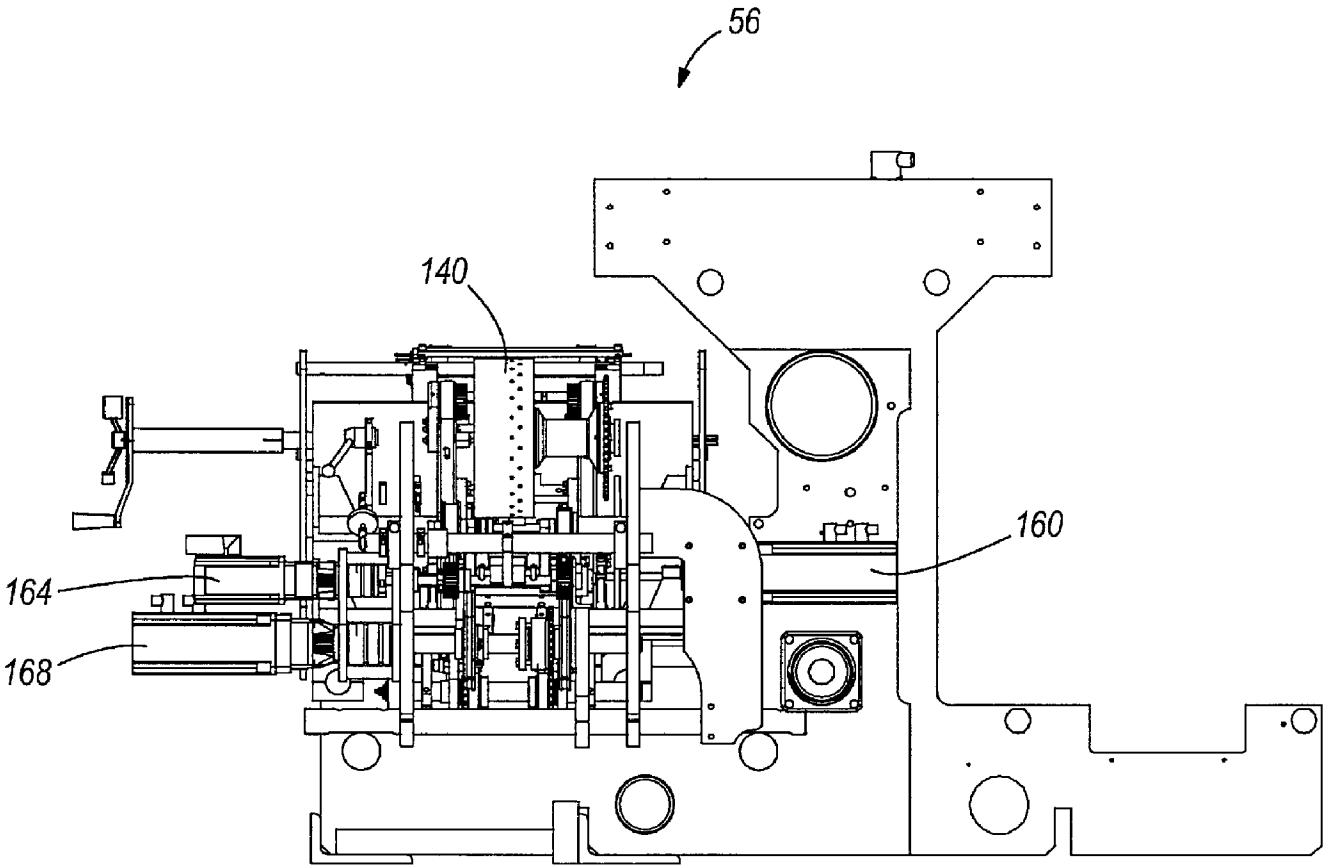
FIG. 2D is a front view of the cover applier system shown in FIG. 2A.

After the signatures are grabbed by the clamp 48, a cover 28 is released from the cover feeder 52. In some constructions, a photo eye (not shown) positioned adjacent to the in-feed roller 104 may detect when the signatures leave the gatherer 32 to trigger release of the cover 28 from the cover feeder 52. The cover 28 is carried by a conveyor 112 toward the cover applier system 56. Before reaching the cover applier system 56, a layer of glue is applied to the binding edge 40 of the clamped signatures as they travel over and/or through a glue pot 188 (FIGS. 2B and 2C). The cover 28 is then applied (e.g., pressed) onto the book block 24 at the cover applier system 56. The assembled book block 24 and cover 28 continue to travel toward the cover breaker 60, where creases are formed in the cover 28 to fold the cover 28 around the book block 24. The assembled book block 24 and cover 28 are then passed to a second conveyor 120.

The second conveyor 120 carries the assembled book block 24 and cover 28 to the trimmer 64 to trim the outside edges of the cover 28 and the book block 24 for cosmetic purposes. The finished book block 24 and cover 28 (i.e., the bound article) may be carried to the polywrapper 68 to enclose the bound article in a wrapper (e.g., a plastic wrapper). The bound article is carried to the distributor 72 so that it may be sorted for mailing and distribution.

FIGS. 2A-6 illustrate the cover applier system 56 in more detail. The cover applier system 56 is configured to facilitate proper longitudinal alignment (i.e., alignment along a path of travel of the book blocks 24 and the covers 28) between the book block 24 and the cover 28. The illustrated system 56 may be configured to tolerate an offset 'x' (FIG. 7) between the book block 24 and the cover 28. In one embodiment, the offset may be, for example, about 0.031 inches, although in other embodiments the tolerated offset may be larger or smaller. As further described below, the cover applier system 56 may also be configured to facilitate proper lateral alignment (i.e., alignment perpendicular to the path of travel) and to minimize skew (i.e., twist or rotation) of the cover 28 relative to the book block 24.

Figure 6:
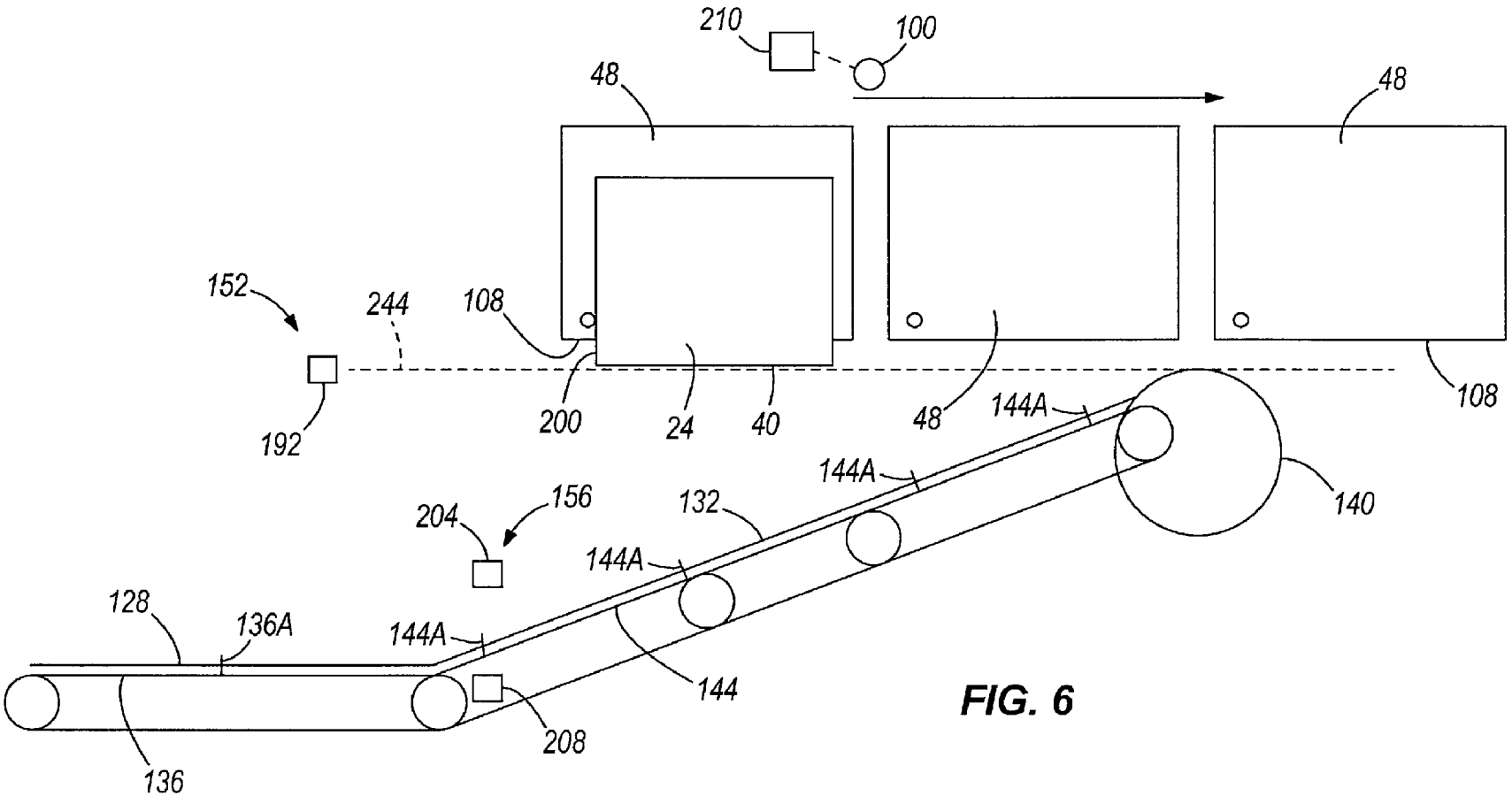
FIG. 6 is a schematic illustrating application of a cover to a book block.

In the illustrated embodiment and with reference to FIGS. 2A and 6, the cover applier system 56 includes a conveyor system 124 having a horizontal portion 128 and an inclined portion 132, a driven member 136 positioned beneath the horizontal portion 128, a pair of driven members 144, 148 positioned beneath the inclined portion 132, a cover applier drum 140, a first position sensor 152, and a second position sensor 156 (FIG. 6). In the illustrated embodiment, the driven member 136 is a cover chain and the driven members 144, 148 are lugged belts. In other embodiments, the driven members 136, 144, 148 may be any one of chains, lugged belts, steel braided belts, conveyors, or the like. The illustrated cover applier system 56 also includes a first, or applier drum, drive unit 160 to drive (e.g., rotate) the applier drum 140, a second, or lugged belt, drive unit 164 to drive the first and second lugged belts 144, 148, and a third, or cover chain, drive unit 168 to drive the cover chain 136. In the illustrated embodiment, the drive units 160, 164, 168 are servo motors. In other embodiments, the drive units 160, 164, 168 may be vector motors or the like. Alternatively, the first and second lugged belts 144, 148 may be driven by separate drive units to help adjust for skew of the cover 28 relative to the book block 24.

The illustrated cover chain 136 is composed of two parallel chains and includes a series of outwardly extending projections, or lugs 136A (FIG. 6). In some embodiments, the cover chain 136 can be extended or can be comprised of multiple chains to extend back to the cover feeder 52. In other embodiments, the cover chain 136 can extend further along the inclined portion 132 of the conveyor system 124. The illustrated cover chain 136 is driven by the cover chain drive unit 168 through a drive sprocket 178 and a series of idle sprockets 179 (FIG. 3E) positioned throughout the conveyor system 124. The lugs 136A extend through slots 172 in the horizontal portion 128 and engage a trailing edge 176 of the cover 28

(FIGS. 7-9) to push the cover 28 toward the inclined portion 132 of the conveyor system 124. At the inclined portion 132, the lugs 136A of the cover chain 136 fall away (i.e., rotate to a position beneath the horizontal portion 128) such that the cover chain 136 no longer engages and pushes the cover 28.

The first and second lugged belts 144, 148 are arranged in parallel and synchronized with each other. Similar to the cover chain 136, the illustrated lugged belts 144, 148 include a series of outwardly extending projections, or lugs 144A (only one set of which is shown in FIG. 6). The lugs 144A extend through corresponding slots 184 in the inclined portion and engage the trailing edge 176 of the cover 28 after the lugs 136A of the cover chain 136 fall away. As such, the lugs 144A of the lugged belts 144, 148 are offset from the lugs 136A of the cover chain 136 (e.g., by about one half inch) so that the lugs 144A engage the trailing edge 176 of the cover 28 after the cover 28 is released by the lugs 136A of the cover chain 136. In other embodiments, the lugs 144A could move from an upstream position of the lugs 136A of the cover chain 136 to a downstream position of the lugs 136A of the cover chain 136 over the course of an overlapping portion of the driven members 136, 144, 148. In this way, the cover 28 would be seamlessly passed from the cover chain 136 to the belts 144, 148.

Figure 3A:
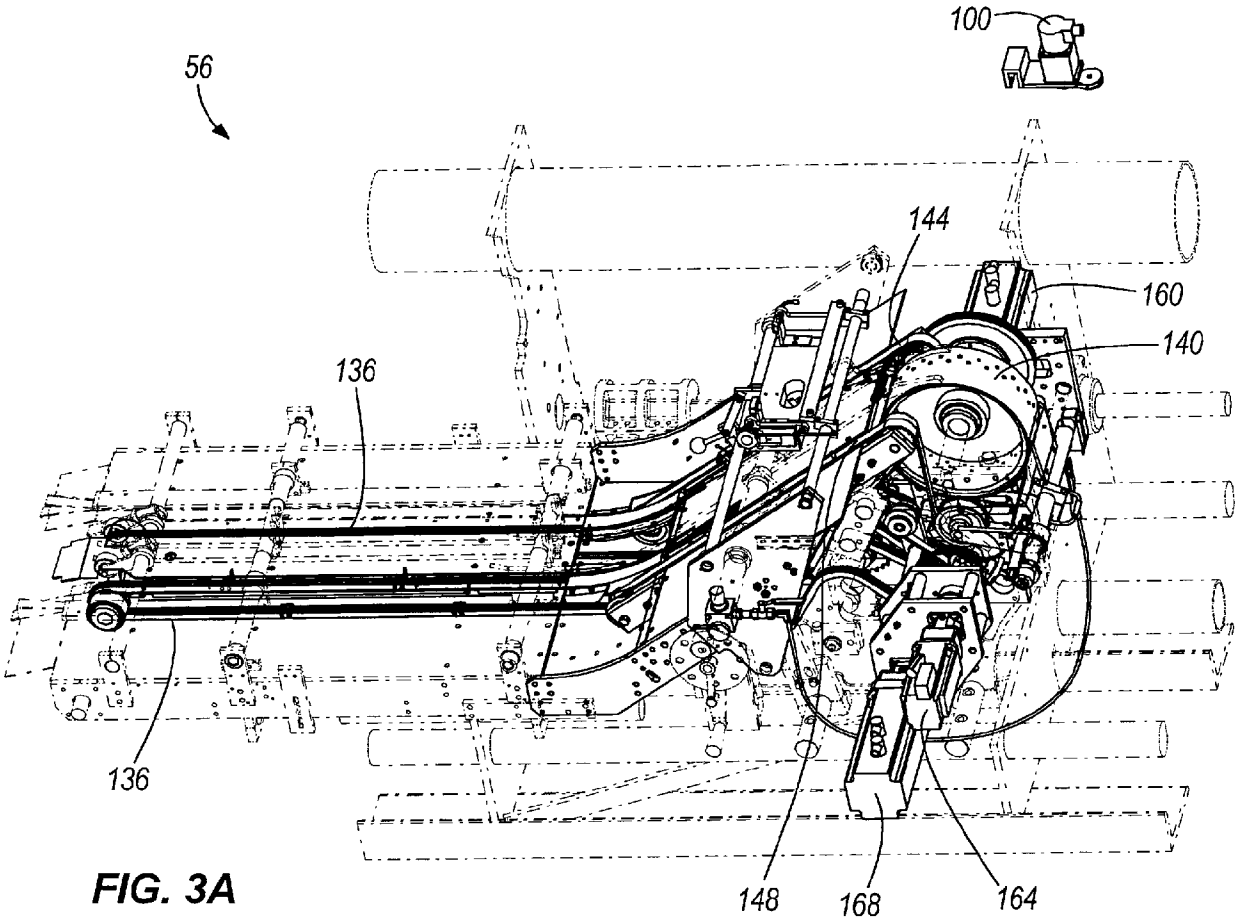
FIG. 3A is a perspective view of an internal portion of the cover applier system shown in FIG. 2A.
Figure 3B:
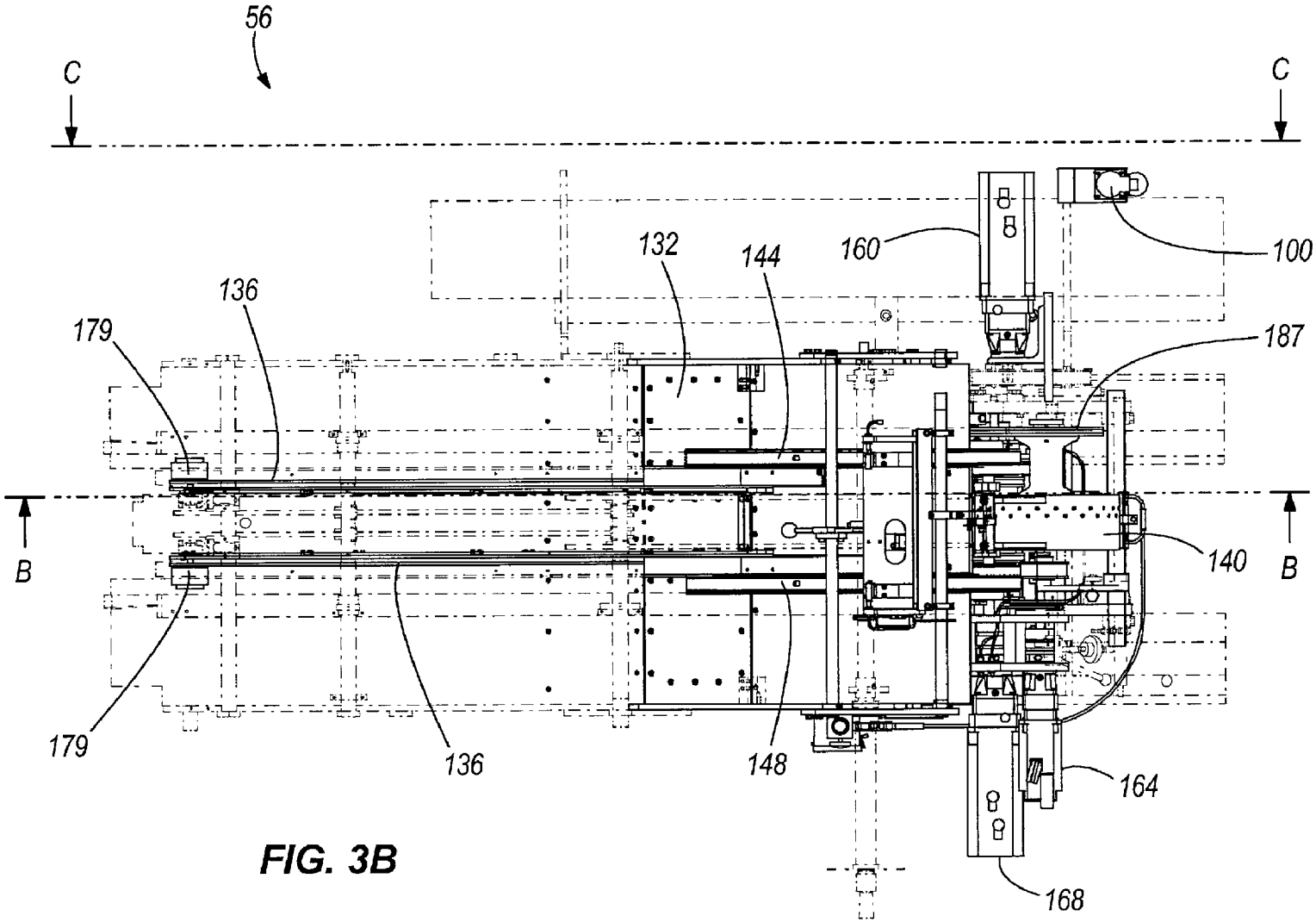
FIG. 3B is a top view of the internal portion of the cover applier system shown in FIG. 3A.
Figure 3C:
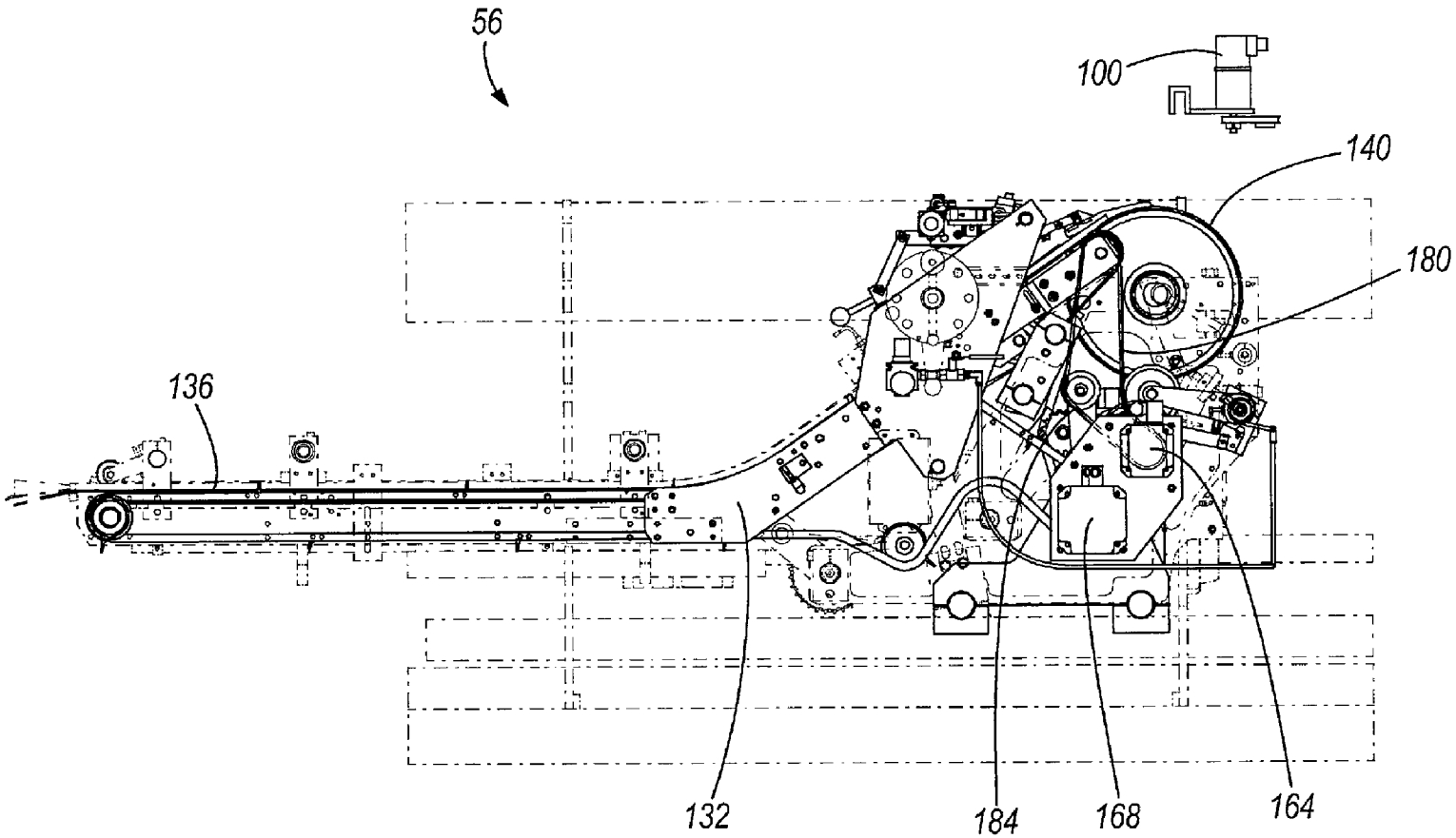
FIG. 3C is a side view of the internal portion of the cover applier system shown in FIG. 3A.
Figure 3D:
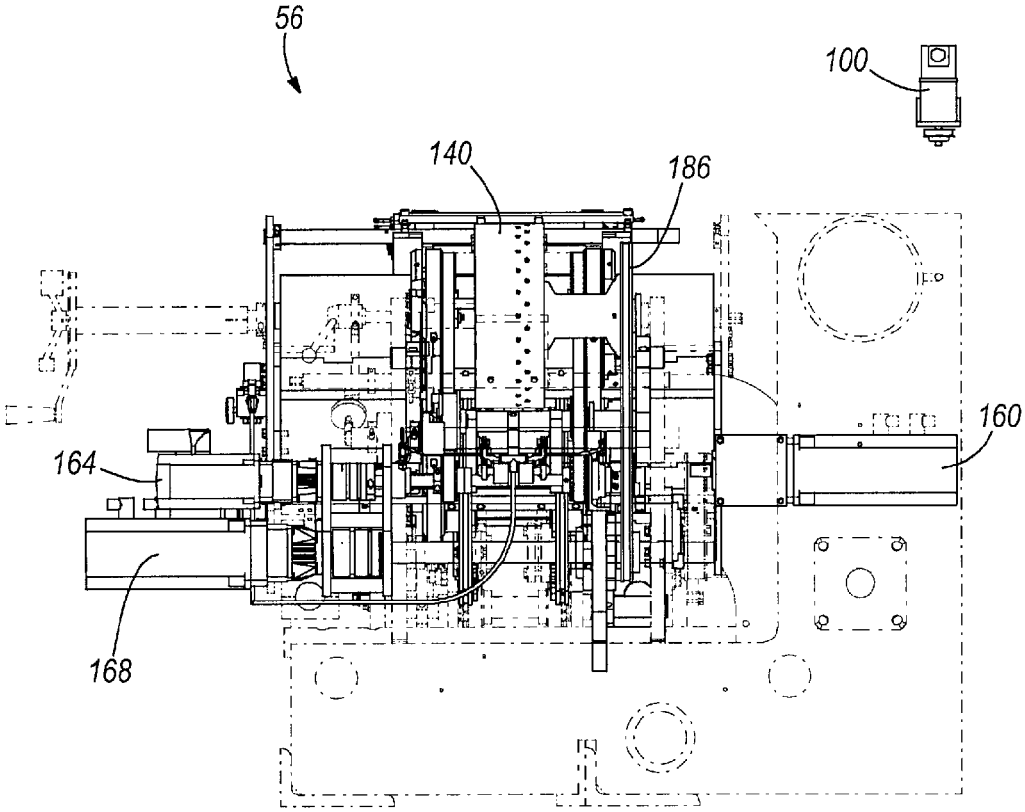
FIG. 3D is a front view of the internal portion of the cover applier system shown in FIG. 3A.
Figure 3E:
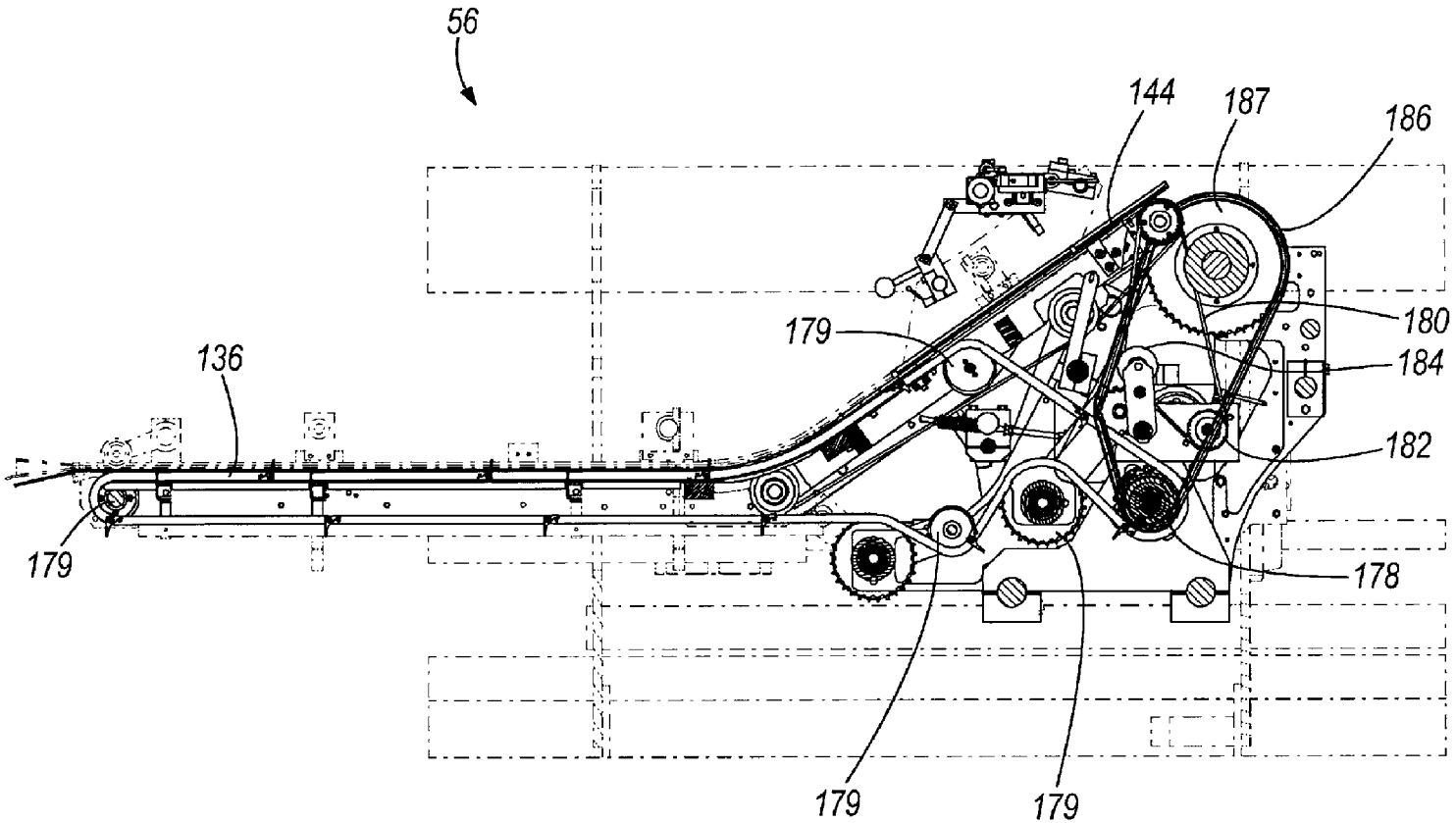
FIG. 3E is a cross-sectional view of the internal portion of the cover applier system taken along line B-B of FIG. 3B.
Figure 3F:
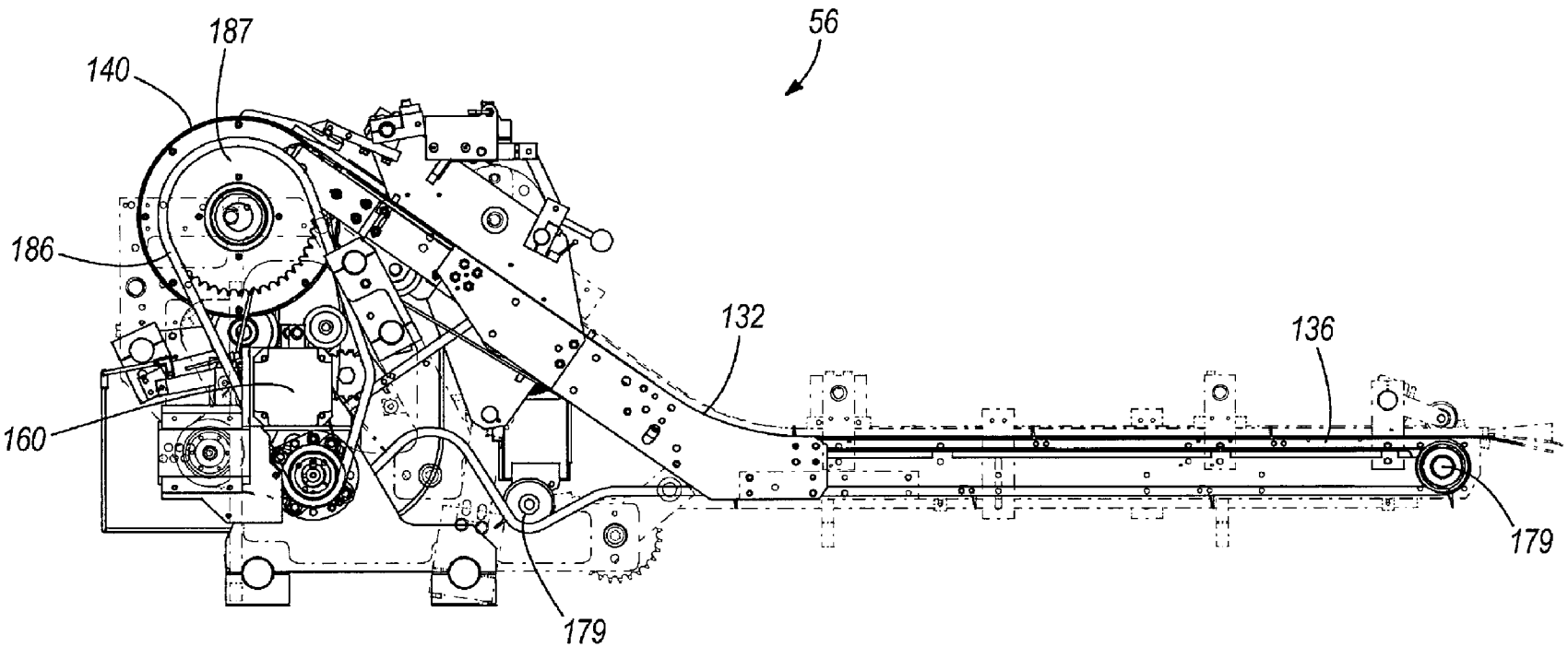
FIG. 3F is a side view of the internal portion of the cover applier system taken along line C-C of FIG. 3B.
Figure 4A:
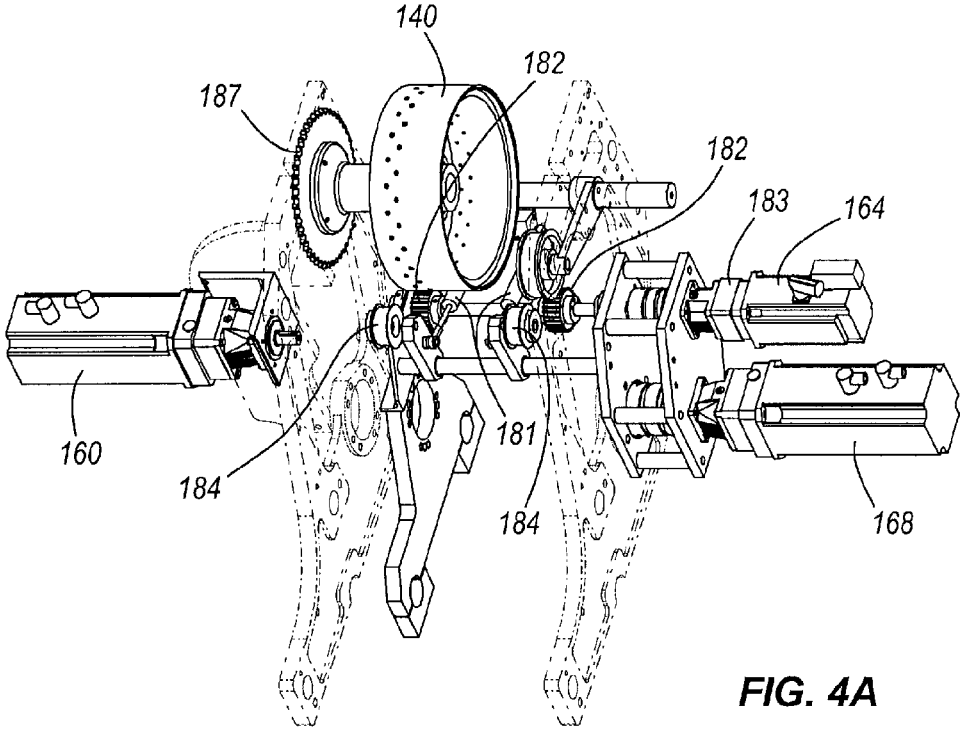
FIG. 4A is a perspective view of a portion of the cover applier system shown in FIG. 2A.
Figure 4B:
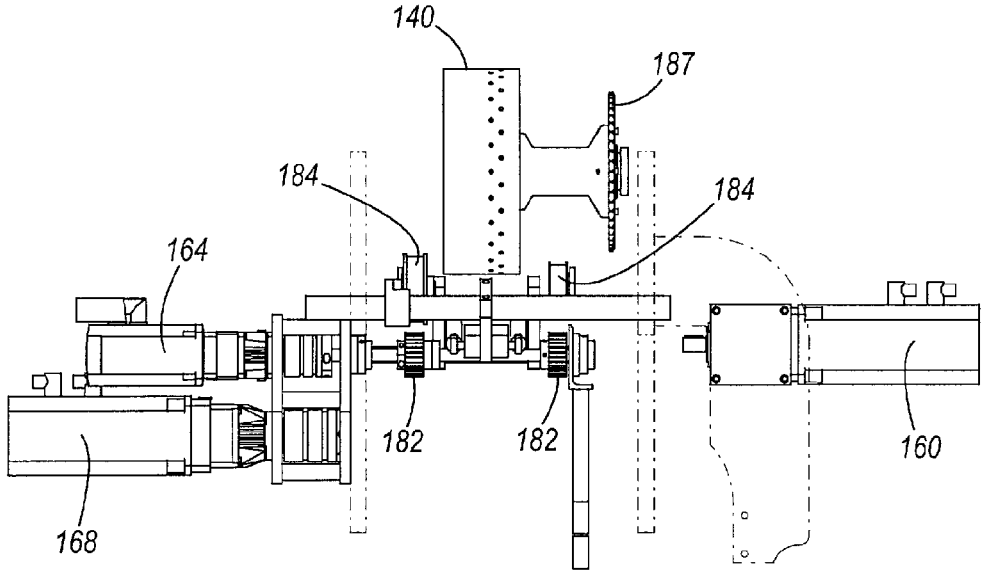
FIG. 4B is a front view of the portion of the cover applier system shown in FIG. 4A.
Figure 4C:
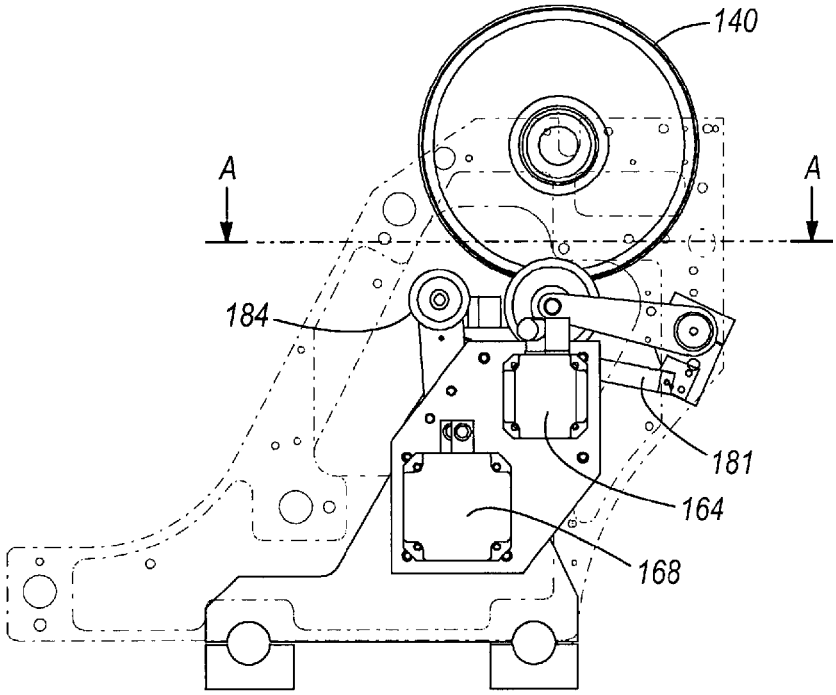
FIG. 4C is a side view of the portion of the cover applier system shown in FIG. 4A.
Figure 4D:
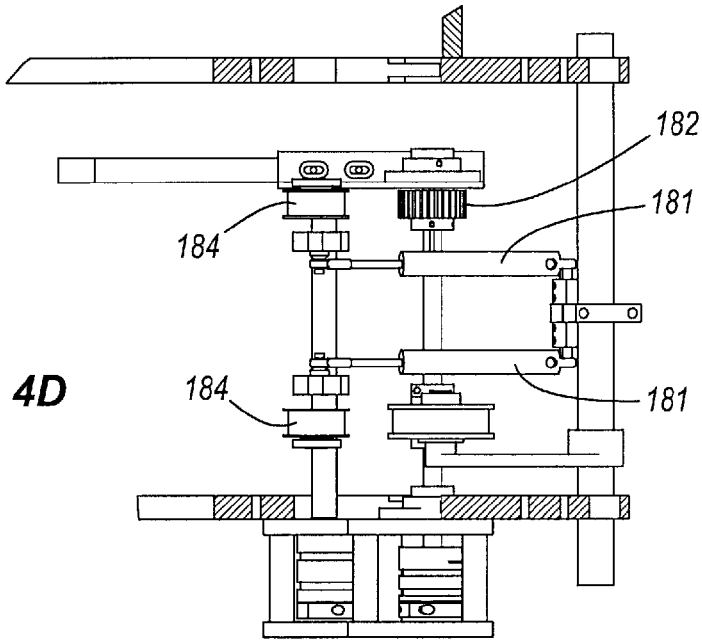
FIG. 4D is a cross-sectional view of the portion of the cover applier system taken along line A-A of FIG. 4C.

As shown in FIGS. 3A and 3E, the lugged belt drive unit 164 drives the lugged belts 144, 148 through secondary belts 180 and sprockets 182. Tensioners 181 (e.g., air cylinders, spring-loaded tensioners, or the like) may be coupled to pulleys 184 adjacent to the secondary belts 180 to move the pulleys 184 relative to the belts 144, 148, thereby providing tension to the lugged belts 144, 148. The rotational speed of the lugged belts 144, 148 may be adjusted by a servo motor through a gear box 183 (FIG. 4A) coupled to the lugged belt drive unit 164.

As shown in FIGS. 2A to 3F, the applier drum 140 is positioned at an end of the inclined portion 132 opposite from the horizontal portion 128 of the conveyor system 124 and helps define an application area where the covers 28 are applied to the book blocks 24. The applier drum drive unit 160 rotates the applier drum 140 through a chain 186 and a large sprocket 187 coupled to the applier drum 140. The applier drum 140 can receive covers 28 from the lugged belts 144, 148 and rotate to maintain the speed and position of the covers 28 relative to the corresponding book blocks 24, facilitating attachment of the covers 28 to the book blocks 24. In the illustrated embodiment, the applier drum drive unit 160 is speed matched to the book clamp chain 81 using the real master encoder 100 for positional reference. Speed matching maintains a substantially similar travel speed between the cover 28 and the book block 24 such that the relative position of the cover 28 and the book block 24 obtained from the position sensor 152 and the real master encoder 100, as discussed below, is not lost.

In the illustrated embodiment, the lugged belts 144, 148 include a camming function provided by the lugged belt drive unit 164. The illustrated lugged belts 144, 148 progressively rotate slower when each cover 28 reaches the applier drum 140 such that the lugs 144A maintain substantially the same linear speed as they rotate beneath the lugged belts 144, 148. Slowing the movement, or travel speed, of the lugs 144A during rotation helps reduce any clipping effects (e.g., unwanted pushing of the cover) that may occur when the cover 28 is transferred from the lugged belts 144, 148 to the applier drum 140.

As shown in FIGS. 2B and 2C, the glue pot 188 is positioned above the horizontal portion 128 of the conveyor system 124 to supply and apply glue to the binding edge 40 of the book block 24 and/or the centerline of the cover 28. The glue pot 188 may be configured to apply the glue when the cover 28 is traveling along the horizontal portion 128 or along the inclined portion 132 of the conveyor system 124. In some embodiments, an electronic viscometer may be positioned inside or adjacent to the glue pot 188. The electronic viscometer would automatically monitor the viscosity of the glue in the glue pot 188. If the viscosity of the glue varied outside of a predetermined range, the viscometer, or a separate device, could alter the viscosity back into the predetermined range. Maintaining a proper viscosity reduces the chance of relative movement between a cover 28 and a book block 24 during folding at the cover breaker 60.

In the illustrated embodiment and with reference to FIGS. 2A and 6, the first position sensor 152 is a photo eye including a source 192 and a receiver 196. In other embodiments, the position sensor 152 may be, for example, a laser line, a high-resolution camera, or the like. The illustrated position sensor 152 is positioned slightly upstream of the inclined portion 132 of the conveyor system 124 and detects a trailing edge 200 of the book block 24 (see FIG. 6). In other embodiments, the position sensor 152 may detect a different edge (e.g., a leading edge) of the book block 24. An air source, such as a compressed air source or a fan, may be positioned near the source 192 and the receiver 196 to provide a steady stream or air across each lens. The stream of air inhibits strands of glue from blocking or waving in front of the lenses and, thereby, triggering or switching the sensor 152.

Similar to the first position sensor 152, the illustrated second position sensor 156 is a photo eye including a source 204 and a receiver 208, but may alternatively be a laser line, a high-resolution camera, or the like. The second position sensor 156 is positioned near the start of the inclined portion 132 of the conveyor system 124 to detect the trailing edge 176 of the cover 28. An air source may also be positioned near the source 204 and the receiver 208 of the second sensor 156 to provide a steady stream of air across each lens.

In operation, the second position sensor 156 detects the cover 28 to help determine a zero position (e.g., a known starting position of the cover relative to the book block) and the first position sensor 152 detects a position of the book block 24 to help determine the position of the book block 24 relative to the zero position. A controller 210 compares the detected position of each book block 24 to the zero position to determine if the corresponding cover 28 being carried by the lugged belts 144, 148 is properly aligned with the book block 24. In the illustrated embodiment, the controller 210 is a separate component in communication with the real master encoder 100 and the position sensors 152, 156. In other embodiments, the controller 210 may be a part of the real master encoder 100.

If the detected position is offset from the zero position, the lugged belt drive unit 164 can apply a short correction speed to the lugged belts 144, 148 to facilitate proper relative positioning between the cover 28 and the book block 24. For example, if the detected position of the book block 24 is ahead, or in front, of the zero position, the controller 210 can send a signal to the lugged belt drive unit 164 to briefly speed up the lugged belts 144, 148 and, thereby, adjust the position of the cover 28 relative to the book block 24. If the detected position of the book block 24 is behind the zero position, the controller 210 can send a signal to the lugged belt drive unit 164 to briefly slow down the lugged belts 144, 148 and, thereby, adjust the position the cover 28 relative to the book block 24.

To set the zero, or home, position, a user turns on the binding system 20 and jogs the book clamp chain 81 to a known position. In some embodiments, the known position may be a predetermined timed offset after one of the book clamps 48 clears the first position sensor 152. The user then feeds a cover onto the lugged belts 144, 148 and drives the lugged belts 144, 148 until a trailing edge of the cover clears the second position sensor 156. The second position sensor 156 notifies the controller 210 and/or the real master encoder 100 when the cover clears the sensor 156 such that the zero position may be defined, or stored, by the encoder 100. In some embodiments, the user may want the cover to be slightly offset from the book block when in the zero position. Accordingly, the user may adjust the zero position by phase advancing or phase retarding the lugged belts 144, 148 relative to the book clamp chain 81 to change the defined zero position. In another embodiment, the zero position may be set by a fully automated, or computer controlled, process.

Figure 5:
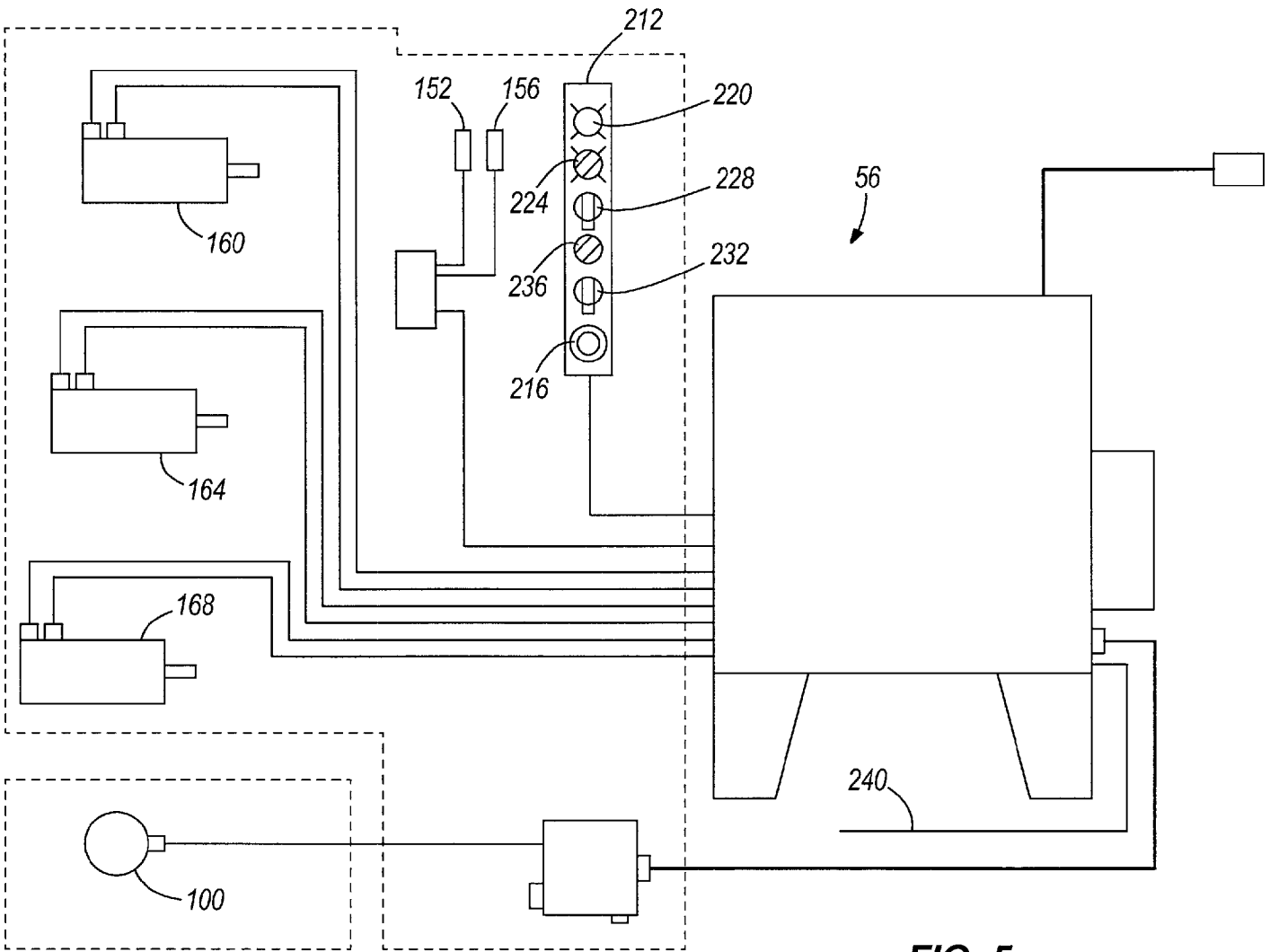
FIG. 5 is a schematic of the cover applier system shown in FIG. 2.

Referring to FIG. 5, the cover applier system 56 includes an operator's control station or controller 212. The controller 212 may include, for example, an E-stop switch 216, a push button 220 to zero the clamp chain 81 to the cover chain 136 and the lugged belts 144, 148, and lights to indicate when the zeroing operation is complete. In addition, the controller 212 may include an auto-correction ON/OFF switch 224 to turn off the correction function if a malfunction occurs, a phasing selector switch 228 for the cover chain 136, a phasing selector switch 232 for the lugged belts 144, 148, and a master phasing switch 236 to phase the cover chain 136 and the lugged belts 144, 148 simultaneously.

The cover applier system 56 also includes a network connection 240 such that data may be sent into and out of the cover applier system 56 through a network cable. The illustrated network connection 240 allows a user to monitor the performance of the cover applier system 56 and troubleshoot the system 56 if a malfunction occurs. For example, the network connection 240 can provide the user with operating information and parameters of the cover applier system 56 (e.g., operating speeds, number of book blocks and covers assembled, current status, etc.). In some embodiments, the operating parameters can help notify a user if one of the book clamps 48 is consistently offset from the zero position. The network connection 240 can allow the user to change the current operating parameters of the system 56, start and stop the system 56, or otherwise adjust the overall functionality of the cover applier system 56.

During operation of the binding system 20, a cover 28 is passed from the conveyor 112 to the horizontal portion 128 of the conveyor system 124. The lugs 136A of the cover chain 136 engage the trailing edge 176 of the cover 28 and push the cover 28 toward the inclined portion 132 of the conveyor system 124. As the cover 28 begins to travel up the inclined portion 132, the lugs 136A of the cover chain 136 fall away. The lugs 144A of the first and second lugged belts 144, 148 then engage the trailing edge 176 of the cover 28 and push the cover 28 up the inclined portion 132 toward the applier drum 140.

During this time, the first position sensor 152 detects the position of a corresponding book block 24. The controller 210 compares the detected position to the zero position to determine if the relative position of the cover 28 and the book block 24 is equal to a predetermined relative position (e.g., the desired relative position of the cover 28 and the book block 24 when the cover 28 is attached to the book block 24). In some embodiments, the predetermined relative position may be, for example, a position where the cover 28 is aligned with the book block 24, a position where the cover 28 is offset downstream of the book block 24, or a position where the cover 28 is offset upstream of the book block 24. If the relative position of the cover 28 and the book block 24 is not equal to the predetermined relative position, adjustments are made to the position of the lugged belts 144, 148, thereby longitudinally adjusting the cover 28 and the book block 24 toward the predetermined relative position. For example, if the detected position of the book block 24 is ahead of the zero position, the lugged belts 144, 148 may be briefly sped up to move the cover 28 to a downstream position relative to the book block 24. If the detected position of the book block 24 is behind the zero position, the lugged belts 144, 148 may be briefly slowed down to move the cover 28 to a more upstream position relative to the book block 24.

When the cover 28 reaches the cover applier drum 140, the cover 28 is at substantially the same height as a book block pass line 244, as shown in FIG. 6. The pass line 244 indicates where the binding edge 40 of the book block 24 is located. As such, the cover 28 contacts and engages the book block 24 in the application area defined by the cover applier drum 140, and the cover applier drum 140 helps attach (e.g., press) the cover 28 onto the book block 24. The book block 24 and the attached cover 28 continue to travel through the binding system 20 toward the cover breaker 60.

Although operation of the cover applier system 56 is discussed above comparing a position of a book block to a zero position and then adjusting a position of a cover accordingly, it should be readily apparent to one skilled in the art that these functions may be reversed. For example, in another embodiment, a position of a cover may be compared to a zero position and/or a position of the book block may be adjusted accordingly by adjusting the speed/position of the book clamp chain 81.

The cover applier system 56 discussed above includes three separate driven members (e.g., the cover chain 136, the lugged belts 144, 148, and the cover applier drum 140) independently driven by three separate drive units (e.g., the first, second, and third drive units 160, 164, 168). In other embodiments, the system 56 may include fewer driven members driven by fewer drive units. For example, in another embodiment (not shown), a cover applier system can include two lugged belts coupled to a cover applier drum. The lugged belts may extend back toward the cover feeder 52 and perform the function of both the cover chain 136 and the lugged belts 144, 148 discussed above. A single drive unit may drive both the lugged belts and the cover applier drum such that, if the position/speed of the lugged belts is changed to adjust the position of a cover, the position/speed change is also applied to the cover applier drum.

In another embodiment (not shown), a cover applier system can include two lugged belts, a cover applier drum, and two drive units to independently drive the lugged belts and the applier drum. Similar to the embodiment discussed above, the lugged belts can extend back toward the cover feeder 52 and perform the function of both the cover chain 136 and the lugged belts 144, 148 discussed above. However, in such an embodiment, the lugged belts are driven independently of the cover applier drum such that adjustments to the position/speed of the lugged belts are not also applied to the cover drum.

Figure 10:
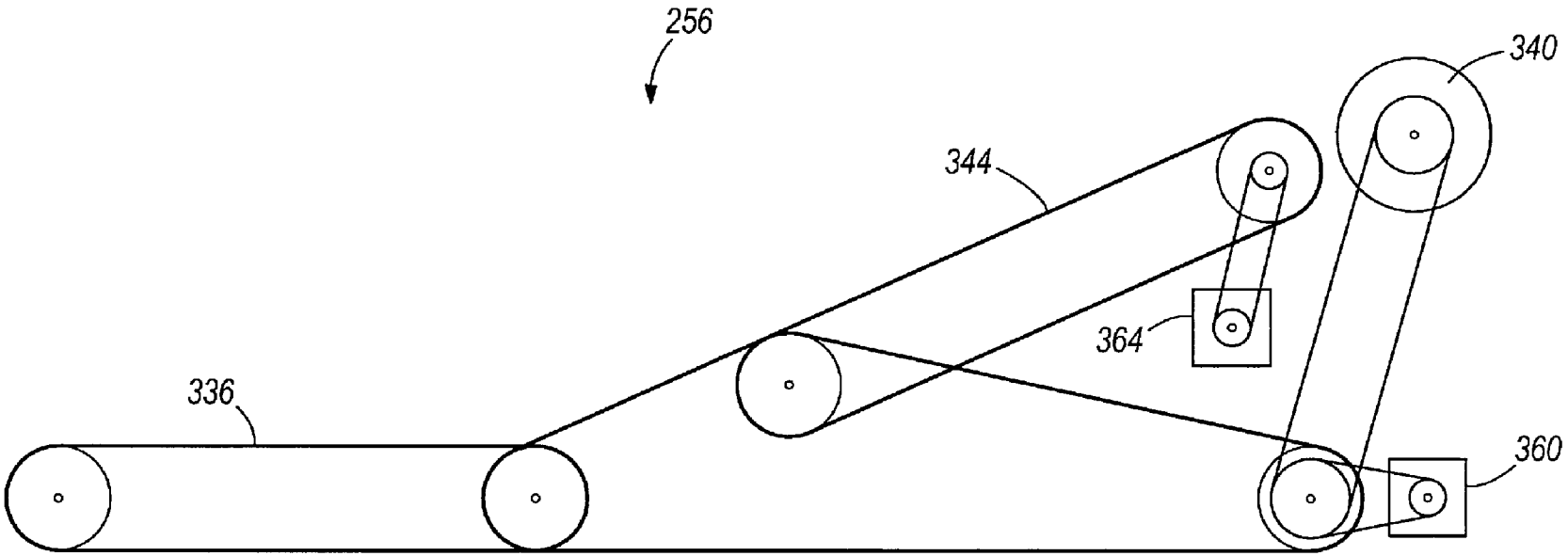
FIG. 10 is a schematic of a cover applier system according to another embodiment of the invention.

FIG. 10 illustrates another embodiment of a cover applier system 256 including a cover chain 336, two lugged belts 344 (only one is shown), and a cover applier drum 340. In the illustrated embodiment, the cover chain 336 and the cover applier drum 340 are driven by one drive unit 360, and the lugged belts 344, 348 are driven by a second drive unit 364. Accordingly, the lugged belts 344 may be similar to the lugged belts 144, 148 discussed above. In addition, the lugged belts 344 may be driven independently of the cover applier chain 336 and the cover applier drum 340 such that adjusting the position of the lugged belts 344 does not effect the position of the cover chain 336 or the cover applier drum 340. However, in this embodiment, both the cover chain 336 and the cover applier drum 340 are driven by the first drive unit 360, reducing the total number of drive units required.

Figure 11:
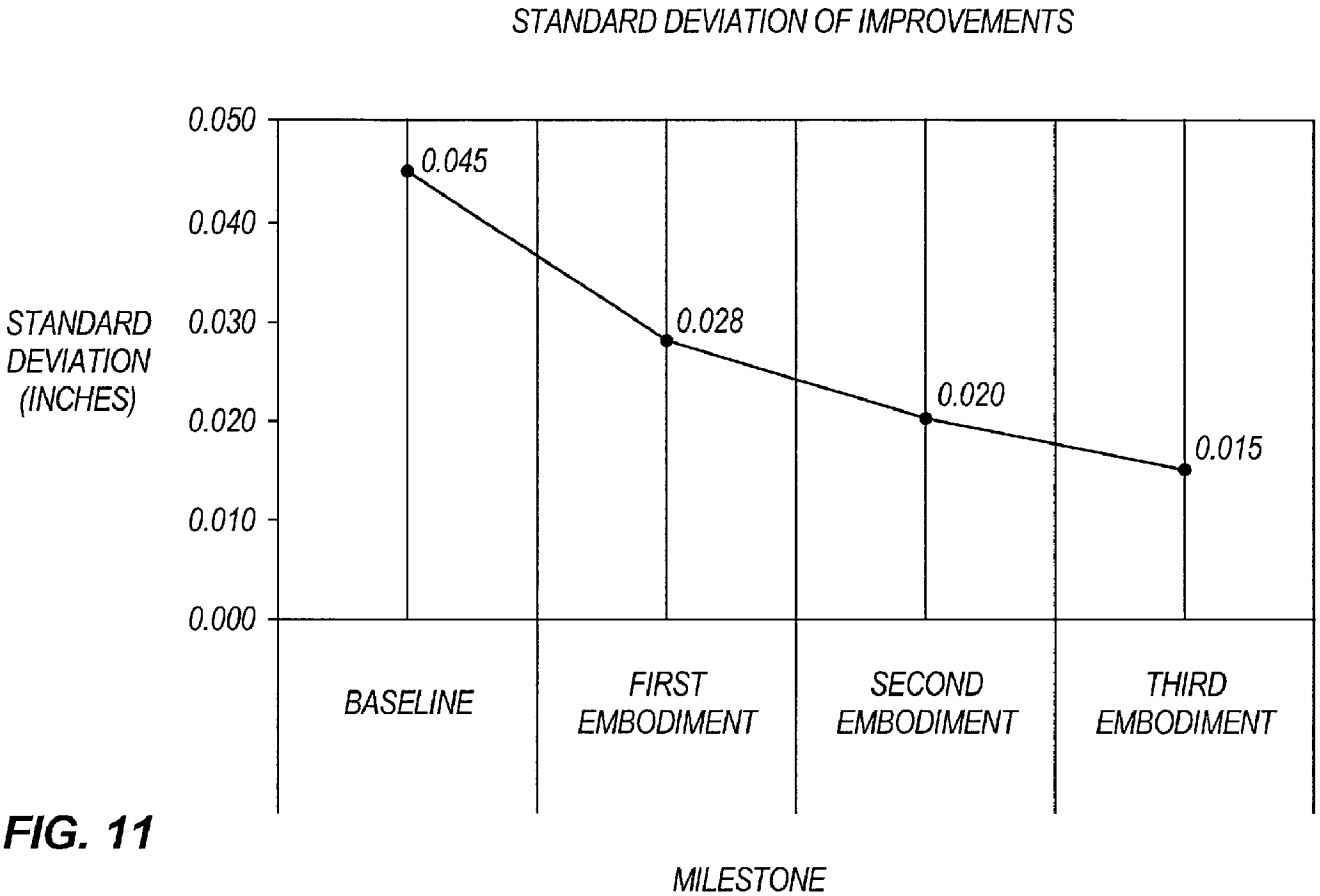
FIG. 11 is a graph depicting standard deviations of cover offset versus milestones of the invention.

FIG. 11 is a graph depicting standard deviations of cover offset relative to a book block versus the different milestones, or embodiments, of the cover applier system. The illustrated graph is representative of one configuration of the cover applier system, and numerical values of the standard deviations may vary based on the final components and tolerances allowed. The "BASELINE" value is equivalent to when a cover applier system is not present. The "FIRST EMBODIMENT" value is equivalent to a cover applier system including two driven members driven by a single drive unit (e.g., the two lugged belts, cover applier drum, and single drive unit embodiment). The "SECOND EMBODIMENT" value is equivalent to a cover applier system including two driven members driven by two separate drive units (e.g., the two lugged belts, cover applier drum, and two drive unit embodiment). The "THIRD EMBODIMENT" value is equivalent to a cover applier system including three driven members driven by three separate drive units (e.g., the cover chain, two lugged belts, cover applier drum, and three drive unit embodiment of FIGS. 2A-6). As shown in FIG. 11, the standard deviation of cover offset for the "BASELINE" system is about 0.045 inches, the standard deviation of cover offset for the "FIRST EMBODIMENT" is about 0.028 inches, the standard deviation of cover offset for the "SECOND EMBODIMENT" is about 0.020, and the standard deviation of cover offset for the "THIRD EMBODIMENT" is about 0.015 inches.

In some embodiments, adjustment of the position of the cover 28 relative to the book block 24 may be based on an eye-to-eye comparison. In such embodiments, the position sensors 152, 156 detect when both the book block 24 and the cover 28 have cleared their respective position sensors 152, 156 and directly compare the two detected positions. Adjustments are then made to the position of the lugged belts 144, 148 to accommodate for any difference in these positions. For example, if the book block 24 clears the first position sensor 152 after the cover 28 clears the second position sensor 156, the lugged belts 144, 148 are briefly slowed down to change the position of the cover 28. If the book block 24 clears the first position sensor 152 before the cover 28 clears the second position sensor 156, the lugged belts 144, 148 are briefly sped up to change the position of the cover 28.

In other embodiments, adjustment of the position of the cover 28 relative to the book block 24 may be based on a print-to-print comparison. In such embodiments, high-resolution cameras may be used as the position sensors 152, 156 to detect the location of print (e.g., lettering, photos, printed marks, etc.) on the inside of the cover 28 and the location of print on the outside of the book block 24. A software package would then compare the relative positions of the two prints and send a signal to the controller 210 to adjust the speed of the lugged belts 144, 148 such that the print on the cover 28 aligns with the print on the book block 24. In such embodiments, the print from the inside of the cover 28 would smoothly transition to corresponding print on the outside of the book block 24. In addition, the print-to-print comparison would facilitate proper centering of the print on the book block 24 and the cover 28 prior to trimming, thereby reducing the amount of trimmed waste and the possibility of trimming away a portion of the print.

Figure 8:
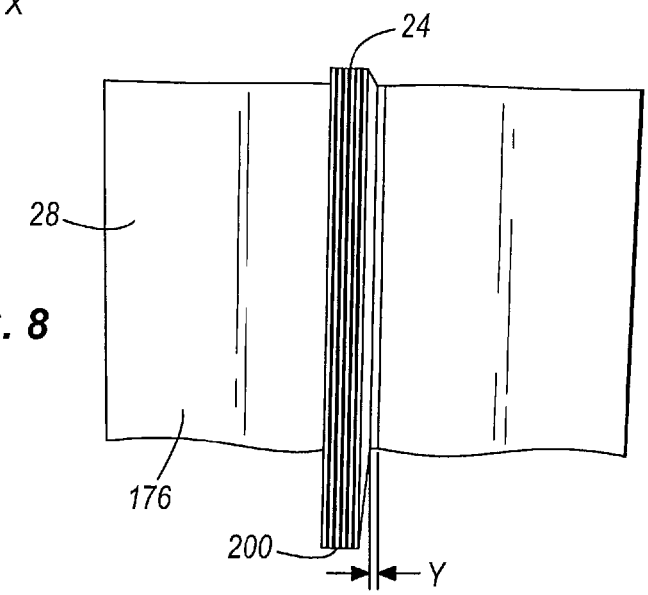
FIG. 8 illustrates the cover offset from the book block laterally.

In some embodiments, the cover applier system 56 may include a lateral positioning device (not shown) to facilitate correct lateral positioning between the book block 24 and the cover 28. As shown in FIG. 8, the lateral positioning device would align the cover 28 such that a distance 'y' between the centerline of the cover 28 and the binding edge 40 of the book block 24 is minimized. In such embodiments, a high-resolution camera may be positioned to detect print on the cover 28 and a pair of side guide rails may adjust the position of the cover 28 accordingly.

Figure 9:
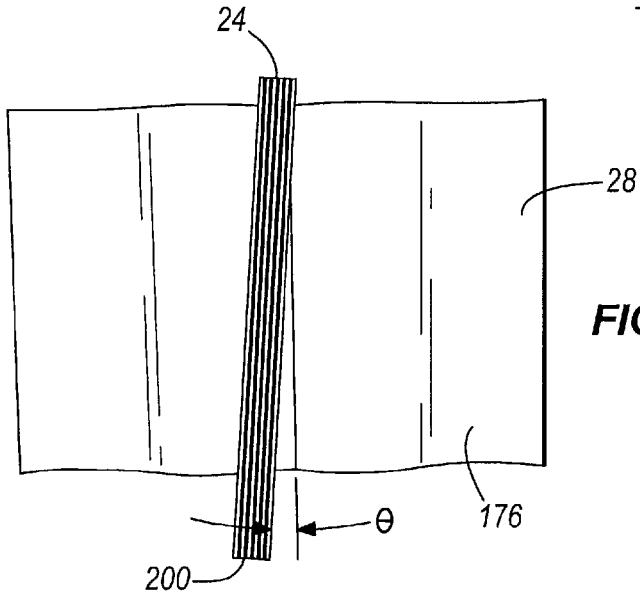
FIG. 9 illustrates the cover skewed relative to the book block.

In some embodiments, the cover applier system 56 may include a skew control device (not shown). As shown in FIG. 9, the skew control device would align the cover 28 such that an angle 'θ' between the centerline of the cover 28 and the binding edge 40 of the book block 24 is minimized. In such embodiments, a high-resolution camera may be positioned to detect print on the cover 28, or photo eyes may be positioned to detect when opposing corners on the trailing edge 176 of the cover 28 pass. The angle of the cover 28 may then be adjusted by independently adjusting the positions of the first and second lugged belts 144, 148 in opposing directions. Additionally or alternatively, the clamps 48 may be coupled to the carousel 44 by pivots operable to automatically rotate the clamps 48, and therefore the book blocks 24, relative to the covers 28.

Various features and advantages are set forth in the following claims.

What is claimed is:

1. A system for positioning a cover relative to a book block, the system comprising:

a first drive unit to cause movement of at least one of the book block and the cover;

a position sensor operable to detect at least one of a position of the book block and the cover, the position sensor operable to generate a position signal indicative of the position;

a controller in communication with the position sensor and the first drive unit, the controller operable to receive the position signal and to control the first drive unit based on the position signal to adjust a relative position of the cover and the book block;

a driven member coupled to the first drive unit and configured to move the at least one of the book block and the cover, and wherein the controller at least one of speeds up and slows down the driven member by controlling the first drive unit to adjust the relative position of the cover and the book block, wherein the driven member is configured to move the cover;

a drum configured to receive the cover from the driven member and apply the cover to the book block; and a second drive unit coupled to the drum to drive the drum independently of the driven member.

2. The system of claim 1, wherein the controller is operable to slow down the first drive unit to slow down the driven member relative to the drum as the drum receives the cover to inhibit clipping of the cover.

3. The system of claim 1, wherein the driven member is a first driven member, and further comprising a second driven member configured to move the cover toward the first driven member, and wherein the first driven member is configured to receive the cover from the second driven member.

4. The system of claim 3, further comprising a third drive unit coupled to the second driven member to drive the second driven member independently of the first driven member and the drum.

5. The system of claim 3, wherein the first driven member comprises a first plurality of lugs configured to receive and engage the cover from the second driven member, and the second driven member comprises a second plurality of lugs configured to engage the cover, and wherein the first plurality of lugs is substantially offset from the second plurality of lugs such that the second plurality of lugs disengage the cover before the first plurality of lugs engage the cover.

6. The system of claim 1, wherein the position sensor detects a trailing edge of the book block, and wherein the position sensor is operable to generate a position signal indicative of the position of the book block.

7. The system of claim 1, further comprising an encoder in communication with the controller, wherein the encoder defines a zero position of the cover and the controller compares the position signal of the book block with the zero position to define a difference, and wherein the controller is operable to control the first drive unit based on the difference to adjust the relative position of the cover and the book block.

8. The system of claim 7, further comprising a second position sensor operable to detect a position of the cover, wherein the second position sensor is operable to generate a cover signal indicative of the position of the cover and the controller is operable to receive the cover signal to define the zero position, and wherein the controller is operable to control the first drive unit to adjust a position of the cover relative to the zero position in at least one of a phase advancing direction and a phase retarding direction.

9. The system of claim 8, wherein the second position sensor detects a trailing edge of the cover.

10. The system of claim 1, wherein the controller controls the first drive unit to adjust a skew of the cover relative to the book block.

11. A method of positioning a cover relative to a book block, the method comprising:

detecting at least one of a position of the book block and the cover;

controlling a driven member transporting at least one of the book block and the cover based upon the detected position to position at least one of the book block and the cover toward a predetermined relative position with respect to one another;

applying the cover to the book block with a drum when the book block and the cover are in the predetermined relative position; and moving the drum independently of the driven member, and slowing down the driven member relative to the drum as the drum receives the cover from the driven member to inhibit clipping of the cover.

12. The method of claim 11, further comprising at least one of speeding up and slowing down the driven member based upon the detected position.

13. The method of claim 11, further comprising detecting a trailing edge of the book block to detect the position of the book block.

14. The method of claim 13, further comprising comparing the detected position of the book block with a zero position of the cover.

15. The method of claim 14, further comprising detecting when the cover is in the zero position, and adjusting the position of the cover relative to the zero position in at least one of a phase advancing direction and a phase retarding direction relative to the book block to define the predetermined relative position.

* * * * *